US005121796A

United States Patent [19]

Wigington, Sr.

[11] Patent Number: 5,121,796

[45] Date of Patent: Jun. 16, 1992

[54] OIL WELL SPILL TROUGH

[76] Inventor: James R. Wigington, Sr., P.O. Box 177, Ackerly, Tex. 79713

[21] Appl. No.: 698,951

[22] Filed: May 13, 1991

[51] Int. Cl.[5] ..... E21B 33/08

[52] U.S. Cl. ..... 166/379; 166/81

[58] Field of Search ..... 166/379, 81, 80, 84; 137/312

[56] References Cited

U.S. PATENT DOCUMENTS

| | | | |
|---|---|---|---|
| 113,638 | 4/1871 | Dewey | 166/81 |
| 1,418,612 | 6/1922 | Beard | 166/81 |
| 1,507,628 | 9/1924 | Schuyler | 166/84 |
| 3,270,810 | 9/1966 | Johnston | 166/81 X |
| 3,353,606 | 11/1967 | Dyer | 166/88 X |
| 4,665,976 | 5/1987 | Retherford | 166/81 |
| 4,949,784 | 8/1990 | Evans | 166/81 |

*Primary Examiner*—Hoang C. Dang
*Attorney, Agent, or Firm*—Wendell Coffee

[57] ABSTRACT

Spills from an oil well are caught in a basin surrounding the oil well casing. The basin is drained from the bottom through a conduit connected to a tank. A vacuum is applied to the tank by a suction pump. The control for starting and stopping the suction pump is by a control which is located above the basin. The control is manually operated by a man who works on a grating above the basin and may see into the basin.

9 Claims, 3 Drawing Sheets

OIL WELL SPILL TROUGH

BACKGROUND OF THE INVENTION (1) Field of the Invention

This invention relates to enhancement of the environment and to the prevention of pollution of the environment. More specifically this invention is to control and contain spills which occur from oil wells during workover of the oil well.

Oil field workers have ordinary skill in the art.

(2) Description of the Related Art

Often oil is produced from deep within the earth by having pumps which pump the oil to the surface of the earth. The pumps, being mechanical devices, often need repair and maintenance. This is normally done with a workover rig which normally will have a derrick to pull sucker rod and tubing from the casing within an oil well. Often, as the sucker rod or the tubing and pump are pulled from the well, oil will flow upward as this process proceeds. Particularly if the tubing is pulled the tubing will often be full of crude oil and as each joint of tubing is disconnected, crude oil within the tubing will run out of the tubing. If the oil spills upon the earth it will often be washed by rain water into streams or percolate through the earth into underground aquifers. In either event, pollution of the water in the stream or in the aquifer will occur.

In addition, the crude oil will often have with it many other substances many of which are more harmful than the petroleum products themselves.

Many people have previously attempted to control leaks and spills around oil wells. For example, the DEWEY U.S. Pat. No. 113,638 issued in 1871, discloses a bag or rubber sock which may be connected around the top of the tubing on an oil well to prevent leakage from an operating oil well from running upon the ground. DYER U.S. Pat. No. 3,353,606, in 1967 and JOHNSTON U.S. Pat. No. 3,270,810 in 1966, show similar flexible containers to prevent the loss of oil. Likewise, BEARD U.S. Pat. No. 1,418,612 in 1922, and RETHERFORD U.S. Pat. No. 4,665,976 in 1987, show rigid containers surrounding the tops of operating oil wells to prevent loss.

EVANS, U.S. Pat. No. 4,949,784 issued in 1990, discloses a basin or vat attached around the top of an operating oil well to catch any leakage therein. In this instance the leakage was drained by gravity into an open pit dug in the ground which is lined with a material such as Fiberglass which would not permit the crude within the sump from seeping into the earth. It is suggested that the sump be emptied by a hose to suck the material from the bottom of the sump. Petroleum products that had leaked from the well would pass through the surface pump.

Applicant believes equipment somewhat like EVANS was used to catch the oil at the time of workover.

SUMMARY OF THE INVENTION (1) Progressive Contribution to the Art

This application discloses a means for preventing loss of fluid from the well at the time the well is being repaired.

This invention discloses a method and means for preventing the spilling or loss of oil at the time the well is being worked over which is to say repaired or maintained. According to this invention, a basin is placed around the casing. The crude which escapes at the time of workover, will often include sand, particles of sludge, and perhaps even some asphalt, drilling mud, or other very thick material which will not readily flow through pipes. Therefore applicant has provided a suction to empty the basin or trough which is placed around the casing. The material which spills or flows out of the top of the casing or spills from the tubing is immediately conveyed from the basin into a closed tank. Certain gases may escape from the crude while it is in the basin that as soon as it is taken from the basin into a closed tank, there will be no further loss of gases or foul smelling vapors from the crude.

This invention utilizes a vacuum pump to evacuate the tank so there is a vacuum formed in the tank which sucks the liquid from the basin or trough around the casing. This prevents any of the sand or other substance which might be abrasive or corrosive from contacting the working elements of the pump. Although some of the vapors are gases within the crude such as hydrogen sulfide or sulphur dioxide might themself be corrosive, they are much less so than the liquid crude itself. Furthermore they do not have any of the abrasive particles such as sand within them.

Sometimes oil wells, although they do not have enough pressure to cause the fluid to flow upward, will still produce a certain amount of pressure. In the event that pressure is produced by the oil wells they are provided with a blow out preventor. In such an event the blow out preventor may be closed and then the pressure relieved from the casing by a valve on the casing which would relieve the pressure of the casing into the trough. The reason for relieving it into the trough is, in the event there was any liquid contained therein so that it might be contained within the trough or basin and tank without pollution of the environment.

For convenience all of the equipment is located upon a trailer. It has been found that the trailer can be placed a considerable distance away from the rig so that it does not interfere with the work going on around the well. With the vacuum transfer of the slop or other liquids flowing from the well, it has been found that they can easily be as much as 100′ from the well. The trailer carries the tank to collect the crude that might otherwise be spilled, also it contains the vacuum pump.

To protect the vacuum pump from any slugs of liquid, a separation tank is located on the trailer.

The operation of the vacuum pump is controlled from the location where the amount of liquid in the basin is visible.

A control for turning the vacuum pump on and off is at the location of the platform above the top of the casing on the workover rig. With the method and means disclosed in particular hereafter it has been possible to prevent spills; therefore preventing the pollution of the environment.

(2) Objects of this Invention

An object of this invention is to prevent pollution of the environment.

Another object of this invention is to prevent crude oil from spilling around an oil well during repair and workover of the oil well.

Further objects are to achieve the above with devices that are sturdy, compact, durable, lightweight, simple, safe, efficient, versatile, ecologically compatible, energy conserving, and reliable, yet inexpensive and easy to manufacture, attach, operate, and maintain.

Other objects are to achieve the above with a method that is rapid, versatile, ecologically compatible, energy conserving, efficient, and inexpensive, and does not require highly skilled people to attach, operate, and maintain.

The specific nature of the invention, as well as other objects, uses, and advantages thereof, will clearly appear from the following description and from the accompanying drawings, the different views of which are not necessarily scale drawings.

As an aid to correlating the terms of the claims to the exemplary drawing(s), the following catalog of elements and steps is provided:

| | |
|---|---|
| 10 oil well | 48 basin |
| 12 casing | 50 inlet nipple |
| 14 casing top | 52 conduit |
| 16 rig | 54 vacuum tank |
| 18 platform | 56 trailer |
| 20 blow out preventor | 58 tank inlet nipple |
| 22 nipple | 60 man hole/dome |
| 24 valve | 62 vacuum pump |
| 26 spool | 64 liquid separator |
| 28 top | 66 vacuum air hose |
| 30 bottom | 68 electric motor |
| 31 disk | 70 switch box |
| 32 drain hole | 72 wire |
| 34 nipple | 74 remote control box |
| 36 hose | 76 clean out opening |
| 38 bolt holes | 78 clean out cover |
| 40 vat | |
| 42 circular hole | |
| 44 gasket | |
| 46 internal flange | |

DESCRIPTION OF THE PREFERRED EMBODIMENTS

Figure 1:
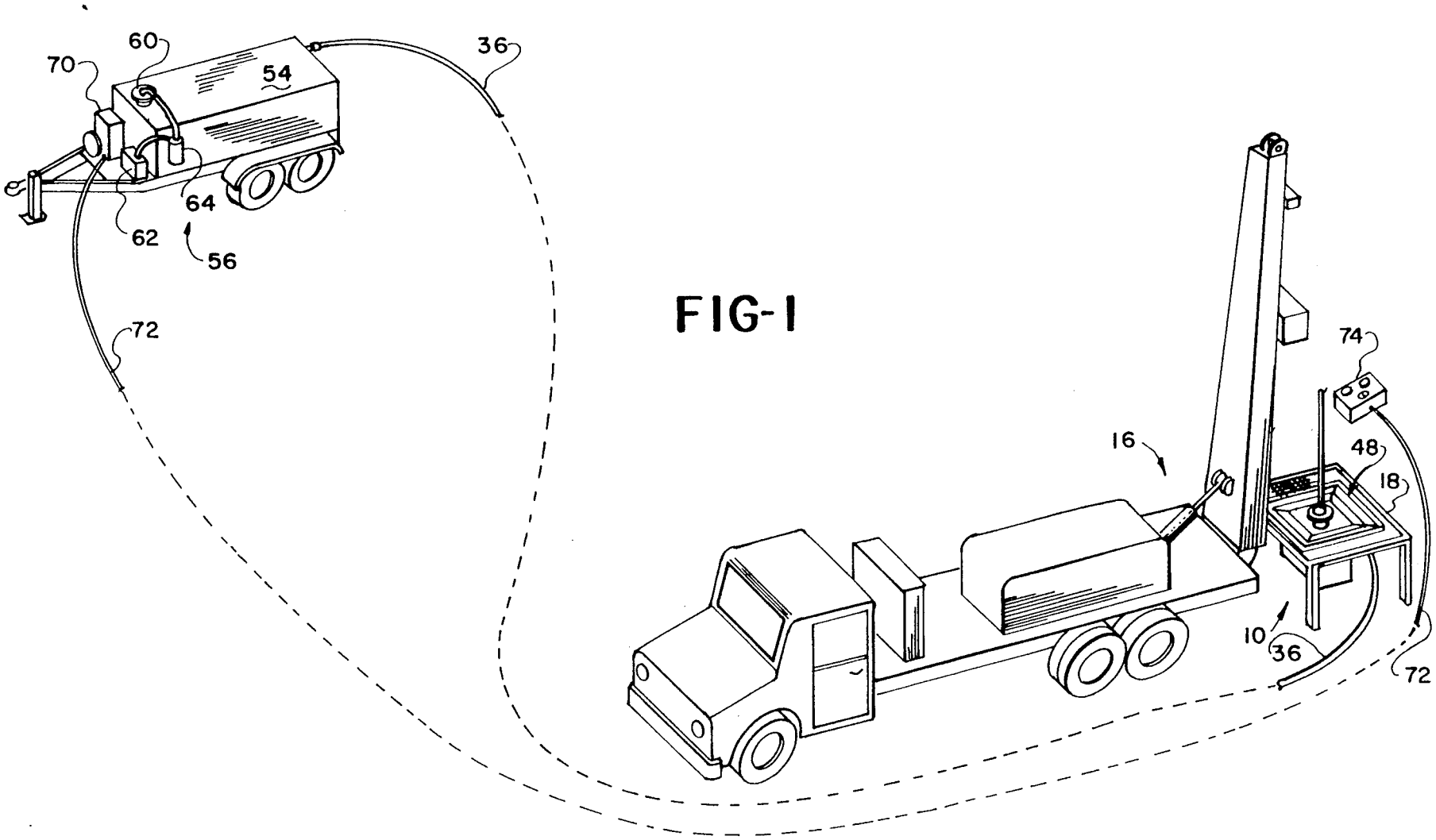
FIG. 1 is a schematic representation of a workover rig with the spill containment and control means according to this invention.
Figure 2:
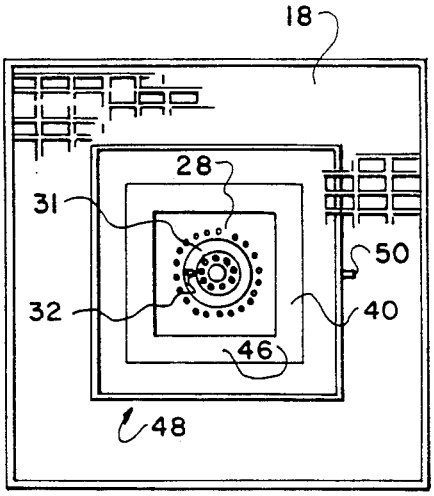
FIG. 2 is a top plan view of the platform around the top of the casing of an oil well with the trough or basin according to this invention below the platform.
Figure 3:
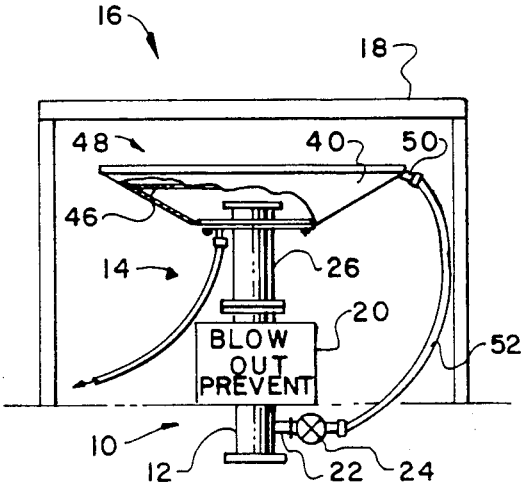
FIG. 3 is a side elevational schematic view of the platform at the top of the casing and the basin according to this invention.
Figure 4:
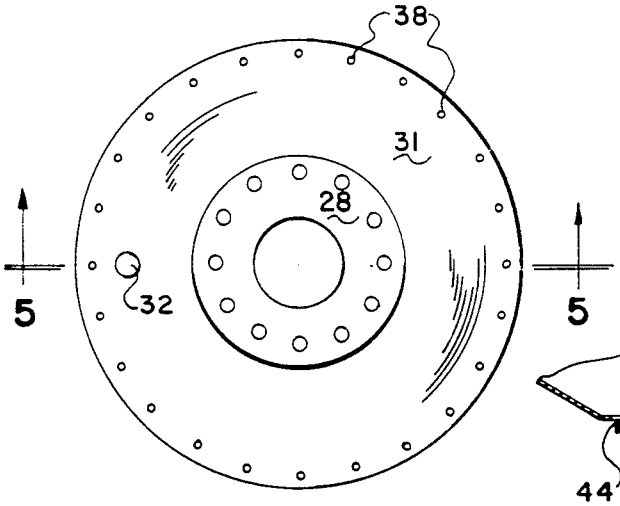
FIG. 4 is a top plan view of the spool with disk which holds the vat forming the basin.
Figure 5:
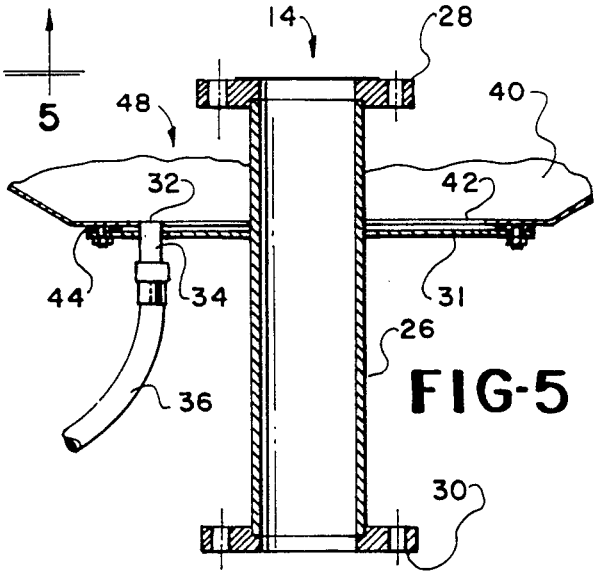
FIG. 5 is a sectional view taken substantially on line 5—5 of FIG. 4 which also shows the vat which together with the structure of FIG. 4 forms the basin.
Figure 6:
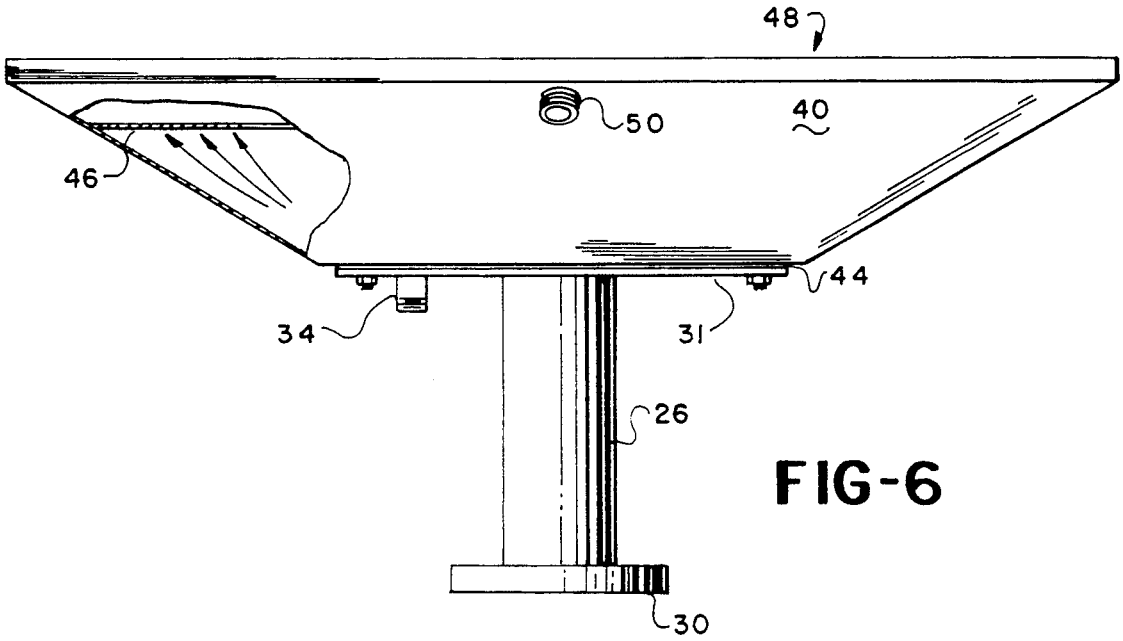
FIG. 6 is a side elevational view of the spool with the basin with parts broken away for clarity.
Figure 7:
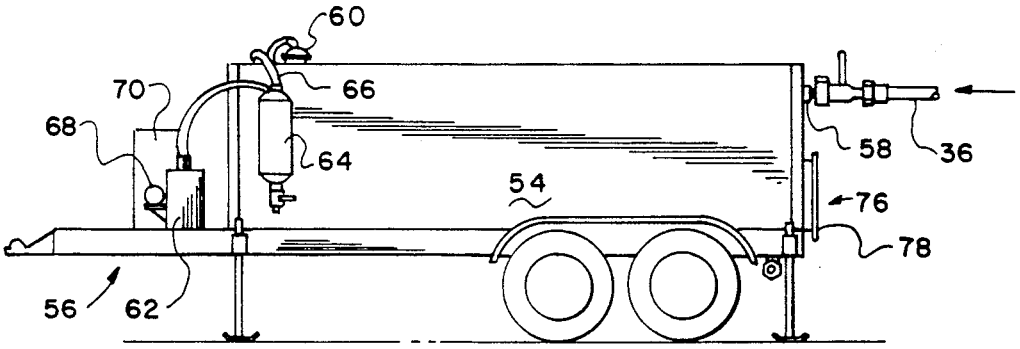
FIG. 7 is a side elevational view of the vacuum tank with the other elements mounted upon the trailer.

Referring to the drawing there may be seen particularly in FIG. 1 and 3 the representation of oil well 10 having casing 12. The casing extends from casing top 14 above the surface of the ground to a bottom far below the surface of the ground.

Also seen is rig 16 which has platform 18 which is around the casing top 14. The platform 18 is conveniently made of grating.

The casing top will include blow out preventor 20. The casing 12 will have nipple 22 in the casing immediately below the blow out preventor 20. Valve 24 will normally be in the off position.

Those having ordinary skill in the art will recognize the equipment described to this point to be old and well known in the oil field work-over art.

According to this invention spool 26 is attached at the casing top 14. The spool between spool top 28 and spool bottom 30 has disks 31 welded thereto. The casing 12 and the axis of the spool 26 will be vertical and the disk 31 will be at right angles to this axis which is to say the disk will be horizontal. The casing 12 will have a certain diameter, for example 5 inches plus or minus a half inch. The disk typically will have a diameter which is about 8 or 10 times the diameter of the casing. The disk will have drain hole 32 in it. The drain hole will have nipple 34 attached below it. The nipple will be a means for connecting 2" hose 36 thereto.

Around the perimeter of the disk 31 there will be a series of bolt holes 38.

Vat 40 has a square outer shape. The vat will have a width and a length about 20 times the diameter of the casing. From the top of the vat 40 to the bottom of the vat will be about twice the casing diameter. The vat will have circular hole 42 in its bottom. A series of bolt holes around the circular hole 42 will mate the bolt holes 38 in the disk 31.

The vat 40 will be bolted to the top of the disk 31. Gasket 44 between the disk and the vat forms a liquid proof seal between the two. Basin 48 is formed by the spool 26, the disk 31, and the vat 40.

Internal flange 46 is an inch or two below the top of the vat 40. The purpose of the internal flange is to prevent liquids which might flow into the basin 48 from splashing out. Internal flange will extend into the vat from the sides thereof a distance about equal to the diameter of the casing.

Inlet nipple 50 is attached at the top of the vat 40 above the internal flange 46. Conduit 52 in the form of a hose is connected from the valve 24 to the inlet nipple 50. Therefore in the event some pressure develops within the casing 12, the blow out preventor 20 may be closed and the valve 24 opened. This will bleed off the pressure from the casing. In the event there are some liquids, either natural or condensate flowing up from the casing, it will drain into the basin 48 as will any spills coming out of the casing.

Hose 36 extends to vacuum tank 54 which is mounted upon trailer 56. Conveniently the trailer will be located 100 feet from the casing so that the trailer is clear of the casing and the rig 16 and the workmen working around it. Also explosion safety measures require it to be about 100 feet from the casing. The hose 36 will be connected into tank inlet nipple 58 upon the vacuum tank 54 near the top thereof. The vacuum tank will include man hole with cover or dome 60 on the top thereof.

Pump 62 is mounted upon the trailer 56. The inlet of the vacuum pump is connected to a liquid separator 64 which is also on the trailer. The inlet of the liquid separator is connected by a suitable vacuum air hose 66 to the man hole/dome 60. Preferably electric motor 68 is drivingly connected to the vacuum pump. The electric motor is supplied with electricity from switch box 70 also mounted upon the trailer 56. In the event that electric power is not available at the site of the well 10, an internal combustion engine may be used in the place of the electric motor. Internal combustion engines with remote starting controls are commercially available upon the market.

In the event the electrical switch box 70 as in the preferred embodiment is used, the starting control from the switch box 70 extends by remote electrical control wire 72 to remote control box 74. The foreman of the work crew upon the platform 18 will have the remote control box 74 readily available to him.

Therefore in operation, if liquid or liquid mixed with sand, mud, paraffin or other material found within the oil well 10 are pulled up through the casing 12, spills over the casing top 14, it will flow over into the basin 48. As stated before, the internal flange 46 will prevent the liquid from splashing out of the basin. If the basin begins to fill, the foreman, by operation of the control box 74, can through the means of the switch box 70, start the electric motor 68 which will pull a vacuum through the liquid separator upon the vacuum tank 54. Having a pressure less than atmospheric pressure upon the vacuum tank will be transferred to the basin by the hose 36 and the atmospheric pressure upon the liquid in the basin 48 will force the liquid slop in the basin through the hose into the vacuum tank 54. In the event that some of the liquid in the vacuum tank should reach the outlet in the dome 60, the liquid will be caught in the separator tank 64. If liquids continue to flow into the basin, obviously the motor would remain running to pull the liquid out of the basin substantially simultaneously with pulling the tubing from the casing. However, if there is no continuing flow from the casing the motor would be turned off by the control box 74 when the basin was emptied or nearly so.

Large clean out opening 76 with a clean out cover 78 is on the vacuum tank. Therefore after the work upon the oil well 10 is completed, the tank on the trailer can be hauled to a place of disposal and the tank emptied by the clean out opening 76 at a place of disposal. Also there are valve nipples (not shown) upon the vacuum tank in the event the slop caught and contained in the vacuum tank will readily flow from the vacuum tank.

The embodiment shown and described above is only exemplary. Many details are often found in the art such as: gauges and safety valves on the vacuum tank and explosion proof motors, switch boxes, etc. Therefore many such details are neither shown nor described. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. A process involving an
a. oil well and rig having
b. a casing having
i. a top above the surface of the earth, and
ii. a bottom far below the surface of the earth,
iii. tubing in the casing, and
c. a platform on the rig extending around the casing,
d. said platform made of grating;
e. wherein the improved method comprises:
ea. pulling the tubing from the casing,
eb. disconnecting joints of tubing thereby
ec. spilling liquids from the casing,
f. catching spilled liquids from the casing in a basin below the platform,
g. draining the basin substantially simultaneously with pulling the tubing as defined above by sucking the liquid from a drain hole in the bottom of the basin by the steps of
h. connecting the drain hole to a tank, and
j. reducing the pressure in the tank to less than atmospheric pressure.

2. The invention as defined in claim 1 wherein said draining step is initiated by operation of a control located above the basin.

3. In an oil well and rig having
a. a casing having
i. a top above the surface of the earth, and
ii. a bottom far below the surface of the earth, and
b. the rig having a platform extending around the casing,
c. said platform made of grating;
d. wherein the improvement comprises:
e. a basin surrounding the casing and connected thereto,
ea. the basin having an open top,
eb. an internal horizontal flange within the basin below the top of the basin to prevent the liquid within the basin from splashing out of the basin,
f. the basin below the platform,
g. a drain connection in the lower part of the basin,
h. a conduit connected to the drain, and
j. means for applying a suction to the conduit.

4. The invention as defined in claim 3 wherein said drain connection in the lower part of the drain is above the surface of the earth.

5. In an oil well and rig having
a. a casing having
i. a top above the surface of the earth, and
ii. a bottom far below the surface of the earth, and
b. the rig having a platform extending around the casing,
c. said platform made of grating;
d. wherein the improvement comprises:
e. a basin surrounding the casing and connected thereto,
f. the basin below the platform,
g. a drain connection in the lower part of the basin,
h. a conduit connected to the drain, and
j. means for applying a suction to the conduit,
k. a tank connected to the conduit, and
l. a suction pump attached to the top of the tank.

6. The invention as defined in claim 5 further comprising:
m. the tank and suction pump are spaced about 100 feet from the basin.

7. The invention is defined in claim 5 further comprising:
n. said pump controlled by a switch located above said platform.

8. In an oil well and rig having
a. a casing having
i. a top above the surface of the earth, and
ii. a bottom far below the surface of the earth, and
b. the rig having a platform extending around the casing,
c. said platform made of grating;
d. wherein the improvement comprises:
e. a basin surrounding the casing and connected thereto,
f. the basin below the platform, g. a drain connection in the lower part of the basin,
h. a conduit connected to the drain, and
j. means for applying a suction to the conduit.
k. a blow-out preventor below the basin,
l. a nipple in the casing below the blow-out preventor, and
m. a valve on the nipple; and
n. wherein the improvement further comprises:
o. a conduit from the valve on the nipple to an intake on the basin below the top of the basin.

9. In an oil well and rig having
a. a casing having
i. a top above the surface of the earth, and
ii. a bottom far below the surface of the earth, and
b. the rig having a platform extending around the casing,
c. said platform made of grating;
d. wherein the improvement comprises:
e. a basin surrounding the casing and connected thereto,
f. the basin below the platform,
g. a drain connection in the lower part of the basin,
h. a conduit connected to the drain, and
j. means for applying a suction to the conduit.
k.
i. a spool attached to the top of the casing.
ii. said spool having a disk welded thereto,
iii. said disk having a perimeter.
l. a plurality of bolt holes around the perimeter.
m. said drain connection being in said disk.
n. a vat bolted to the top of the disk,
o. a gasket between the vat and the disk.
p. said vat and disk forming said basin.
q. a splash flange in the vat.
r. a blow-out preventor in the casing below said spool.
s. a nipple in the casing below said blow-out preventor.
t. a valve on said nipple.
u. a conduit connecting the valve to the vat above said splash flange,
v. a trailer, said trailer located about 100 feet from the casing,
w. a tank on the trailer.
x. a conduit extending from the drain connection in the disk to the tank.
y. said tank having a man hole cover above the top of the tank,
z. an outlet in the man hole cover,
aa. a suction pump having an inlet on the trailer,
bb. a connection from the outlet in the top of the man hole cover to a liquid separator,
cc. a connection from the liquid separator to the inlet of the suction pump,
dd. a power unit for the suction pump on the trailer, and
ee. a control wire extending from the power unit to
ff. a control station located above the platform.
gg. said control station being a part of a means for starting and stopping the power unit to the suction pump.

* * * * *